US006020902A

United States Patent [19]

Okitaka

[11] Patent Number: 6,020,902

[45] Date of Patent: Feb. 1, 2000

[54] IMAGE DATA STORING METHOD AND IMAGE DATA STORING DEVICE

[75] Inventor: Takenori Okitaka, Tokyo, Japan

[73] Assignee: Mitsubishi Denki Kabushiki Kaisha, Tokyo, Japan

[21] Appl. No.: 09/034,342

[22] Filed: Mar. 4, 1998

[30] Foreign Application Priority Data

Oct. 31, 1997 [JP] Japan ..... 9-301304

[51] Int. Cl.[7] ..... G09G 5/36

[52] U.S. Cl. ..... 345/509; 345/515; 711/5

[58] Field of Search ..... 345/507–510, 345/515, 516; 365/230.01–230.06, 189.01, 189.04; 711/5.1, 170, 173

[56] References Cited

U.S. PATENT DOCUMENTS 5,473,573 12/1995 Rao ..... 365/230.01

FOREIGN PATENT DOCUMENTS 4-64152 2/1992 Japan ..... G06F 12/06

*Primary Examiner*—Kee M. Tung

*Attorney, Agent, or Firm*—Burns, Doane, Swecker & Mathis, LLP

[57] ABSTRACT

An image data storing device capable of solving a problem involved in a conventional device in that an increasing number of memory bus lines are required which are used for simultaneously reading pixel data from memory elements as the dimension of a screen increases, and that this hinders the device from being integrated. The present image data storing device includes n (a positive integer) physical banks, to which memory buses are connected in one to one correspondence with them. Each physical bank stores image data with their rows and columns different from each other.

8 Claims, 5 Drawing Sheets n=5

| | (*,1) | (*,2) | (*,3) | (*,4) | (*,5) | (*,6) | | | (*,r) |
|---|---|---|---|---|---|---|---|---|---|
| (1,*) | (1,1) | (1,2) | (1,3) | (1,4) | (1,5) | (1,1) | … | (1,4) | (1,5) |
| (2,*) | (2,1) | (2,2) | (2,3) | (2,4) | (2,5) | (2,1) | … | (2,4) | (2,5) |
| (3,*) | (3,1) | (3,2) | (3,3) | (3,4) | (3,5) | (3,1) | … | (3,4) | (3,5) |
| (4,*) | (4,1) | (4,2) | (4,3) | (4,4) | (4,5) | (4,1) | … | (4,4) | (4,5) |
| (5,*) | (1,1) | (1,2) | (1,3) | (1,4) | (1,5) | (1,1) | … | (1,4) | (1,5) |
| | ⋮ | ⋮ | ⋮ | ⋮ | ⋮ | ⋮ | ⋮ | ⋮ | ⋮ |
| (s,*) | (4,1) | (4,2) | (4,3) | (4,4) | (4,5) | (4,1) | … | (4,4) | (4,5) |

p=4

FIG.5 n=4

| | (*,1) | (*,2) | (*,3) | (*,4) | (*,5) | (*,6) | | | (*,l) |
|---|---|---|---|---|---|---|---|---|---|
| (1,*) | (1,1) | (1,2) | (1,3) | (1,4) | (1,1) | (1,2) | ⋯ | (1,3) | (1,4) |
| (2,*) | (2,1) | (2,2) | (2,3) | (2,4) | (2,1) | (2,2) | ⋯ | (2,3) | (2,4) |
| (3,*) | (3,1) | (3,2) | (3,3) | (3,4) | (3,1) | (3,2) | ⋯ | (3,3) | (3,4) |
| (4,*) | (4,1) | (4,2) | (4,3) | (4,4) | (4,1) | (4,2) | ⋯ | (4,3) | (4,4) |
| (5,*) | (1,1) | (1,2) | (1,3) | (1,4) | (1,1) | (1,2) | ⋯ | (1,3) | (1,4) |
| | ⋮ | ⋮ | ⋮ | ⋮ | ⋮ | ⋮ | ⋮ | ⋮ | ⋮ |
| (s,*) | (4,1) | (4,2) | (4,3) | (4,4) | (4,1) | (4,2) | ⋯ | (4,3) | (4,4) |

p=4

IMAGE DATA STORING METHOD AND IMAGE DATA STORING DEVICE

BACKGROUND OF THE INVENTION

1. Field of the Invention

The present invention relates to an image data storing method and image data storing device applicable for various display devices such as liquid crystal displays, and particularly to those which can achieve downsizing, and are preferably applied to two-dimensional or three-dimensional graphics.

2. Description of Related Art

As is well known, a screen of a liquid crystal display consists of a lot of pixels arrayed in a matrix. Such a liquid crystal display generates a picture by controlling the transmittivity (reflectivity) of all the pixels by sequentially applying voltages corresponding to pixel data to liquid crystal elements mounted for individual pixels.

An image data storing device used in such a display device adopts various design ideas because it is necessary for a great number of pixel data to be read within a certain limited time to prevent screen flickering.

FIG. 6 is a block diagram showing a layout of an image data storing integrated circuit considering such an image read time. In FIG. 6, reference numerals 51, 52, 53, 54 and 55 each designate a physical bank, a repetition unit of a memory area in the memory layout; 8*s* designate memory buses, each of which has a bus width of m corresponding to the pixel data, and p (=4, in FIG. 6) of which are each connected to the physical banks 51, 52, 53, 54 and 55; and 61, 62, 63 and 64 each designate a memory group, each of which corresponds to one pixel, and consists of a plurality of memory elements connected to one of the memory buses 8. Reference numerals 71, 72, 73 and 74 each designate a group of n address decoders, each of which is provided for one of the memory groups for selecting a memory element for outputting one pixel data. Thus, the total number of address decoders amounts to p×n. The reference numeral 9 designates a selector for selecting n (=5 in FIG. 6) memory buses 8 from among the plurality of memory buses 8 to output the image data on the selected memory buses 8. Incidentally, the bus width (the number of lines of each bus) m of each memory bus 8 is determined in accordance with the number of gray levels of a pixel, and when the number of bits needed for the pixel is m bits, the bus width is also set at m in general.

Next, the image data storing method of the conventional image data storing integrated circuit will be described.

In the foregoing image data storing integrated circuit, pixels constituting a display picture are divided into pixel groups, each of which consists of p×n pixels. Then, the pixel data (1,1), (1,2), . . . , and (1,n) in the first row are stored in the (1,1) memory group 61, (1,2) memory group 61, . . . , and (1,n) memory group 61, respectively. Likewise, the pixel data (2,1), (2,2), . . . , and (2,n) in the second row are stored in the memory group 62, followed by storing the third row and onward in the same manner. Finally, the pixel data (p,1), (p,2), . . . , and (p,n) in the p-th row are stored in the memory group 64.

Next, the read operation of the conventional device will be described.

In a common image display mode, the pixel data corresponding to the pixels in the first row are successively read on an every n pixel basis by actuating the n address decoders 71, . . . , 71 while setting the selector 9 such that it outputs the data of the memory groups 61, . . . , 61 in the first row, thereby completing the first row. Likewise, the pixel data corresponding to the pixels in the second row are successively read on an every n pixel basis by actuating the n address decoders 72, . . . , 72 while setting the selector 9 such that it outputs the data of the memory groups 62, . . . , 62 in the second row, thereby completing the second row. Thus, all the pixel data of the following rows are read one after the other.

According to the image data storing integrated circuit, since the pixel data can be read in groups of n pixels, the time taken to display a picture is reduced by a factor of n. This enables the pixel data to be read in a time that can prevent the flickering of the picture.

In another operation mode of the image data storing integrated circuit, in which 3-D (three-dimensional) graphics or the like are carried out, pixel data are sometimes rewritten column by column at a location in which a displayed picture changes. In such a case, the p (=4) pixel data in each column can be read by actuating the four address decoders 71, 72, 73 and 74 corresponding to the physical bank 51 (52, 53, 54 or 55), after setting the selector 9 such that it outputs the pixel data in the physical bank 51 (52, 53, 54 or 55).

The conventional image data storing integrated circuit with the foregoing configuration must possess p sets of memory buses for each physical bank. As a result, the number of lines needed for reading the pixel data from each of the physical banks becomes m×p, amounting to m×n×p lines for the entire memory. This presents a problem of hindering downsizing of the memory when handling a large scale, high gray level display image.

SUMMARY OF THE INVENTION

The present invention is implemented to solve the foregoing problem. It is therefore an object of the present invention to provide an image data storing method and an image data storing device capable of handling a large scale, high gradation images with reducing the number of lines of the buses and the size of the memory.

According to a first aspect of the present invention, there is provided an image data storing device comprising: a plurality of physical banks, each of which forms a repetition unit of a memory area, and has a storage capacity that can store a plurality of pixels in each of a plurality of pixel groups formed by dividing a display image; and a plurality of memory buses provided in one to one correspondence with the plurality of physical banks, each of the memory buses having a bus width needed for conveying pixel data associated with at least one of the pixels, wherein the pixel data stored in the plurality of physical banks are simultaneously output through the memory buses to be displayed.

Here, each of the pixel groups may consist of p×n pixels of the display image, and each of the plurality of physical banks can store at least p pixels, wherein p and n are natural numbers.

The natural number p may equal n.

The image data storing device may further comprise a selector for selecting memory buses from among the plurality of memory buses, wherein the selector may simultaneously output one of a set of p pixel data and a set of n pixel data supplied from the plurality of physical banks through the memory buses.

The image data storing device may further comprise p address decoders for selecting memory elements of the plurality of physical banks in parallel, the memory elements each storing at least one of the pixel data.

The image data storing device may further comprise an image data control circuit for controlling such that each of the plurality of physical banks stores pixels with their rows and columns different from each other.

The image data storing device may be formed in an integrated circuit.

According to a second aspect of the present invention, there is provided an image data storing method comprising the steps of: dividing an image data to be displayed into a plurality of pixels groups, each of which consists of p×n pixel data, where p and n are natural numbers; and storing into each of physical banks a set of p pixel data of each of the pixel groups, the p pixel data having different rows and columns from each other.

BRIEF DESCRIPTION OF THE DRAWINGS

FIG. 5 is a diagram showing a matrix of pixels in a liquid crystal display device associated with the embodiment 2.

DETAILED DESCRIPTION OF THE PREFERRED EMBODIMENTS

The invention will now be described with reference to the accompanying drawings.

Embodiment 1

Figures 1, 3:
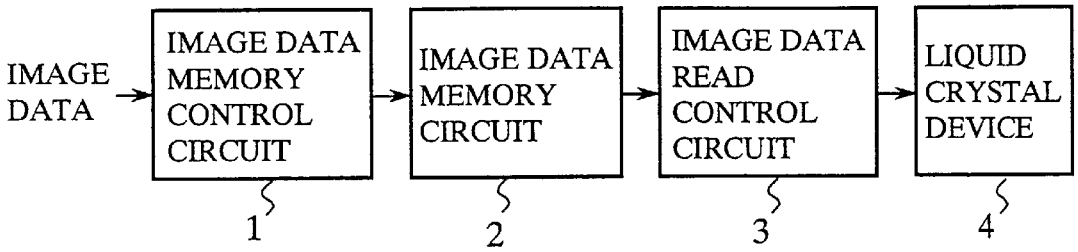
FIG. 1 is a block diagram showing a configuration of an embodiment 1 of an image data storing device in accordance with the present invention, and its neighboring devices.
FIG. 3 is a diagram showing a matrix of pixels in a liquid crystal display device associated with the embodiment 1.

FIG. 1 is a block diagram showing a configuration of an embodiment 1 of an image data storing device in accordance with the present invention, and its neighboring circuits. In FIG. 1, the reference numeral 1 designates an image data memory control circuit for accepting image data sequentially input thereto, and for outputting them in groups consisting of a predetermined number of pixel data; 2 designates an image data memory circuit for storing the pixel data; 3 designates an image data read control circuit for reading from the image data memory circuit 2 the image data in groups consisting of a predetermined number of pixel data; and 4 designates a liquid crystal device for carrying out display based on the image. The image data memory control circuit 1, image data memory circuit 2 and image data read control circuit 3 are implemented as an integrated circuit.

Figure 2:
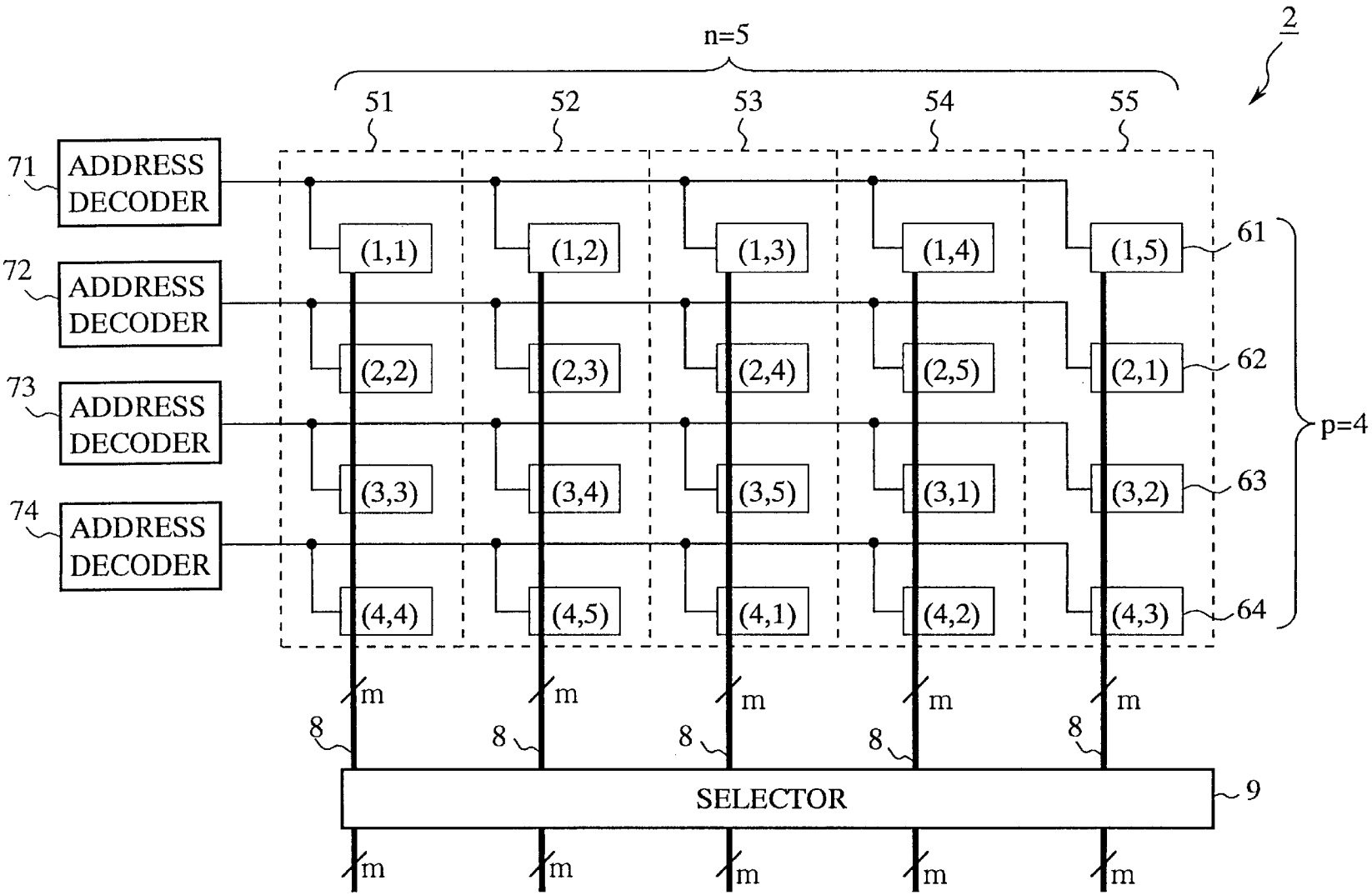
FIG. 2 is a block diagram showing a layout of an image data memory circuit of the embodiment 1.

FIG. 2 is a block diagram showing an layout of the image data memory circuit 2. In FIG. 2, reference numerals 51, 52, 53, 54 and 55 designate n physical banks, each of which constitutes a repetition unit of a storage area in the memory layout. Reference numerals 8*s* designate memory buses, each of which has a bus width of m corresponding to the pixel data, and is connected to one of the physical banks 51, 52, 53, 54 and 55. Reference numerals 61, 62, 63 and 64 each designate a memory group, each of which corresponds to one pixel, and consists of a plurality of memory elements. Each physical bank includes four memory groups 61, 62, 63 and 64. Reference numerals 71, 72, 73 and 74 designate four address decoders for supplying the memory groups 61, 62, 63 and 64 in the physical banks 51, 52, 53, 54 and 55 with control signals for selecting the memory elements for outputting the pixel data. The reference numeral 9 designates a selector for selecting designated memory buses 8 from among the n memory buses 8 to output the image data on the selected memory buses 8.

Next, the operation of the present embodiment 1 will be described.

Receiving image data, the image data memory control circuit 1 supplies the image data memory circuit 2 with every five pixel data. The image data memory circuit 2 supplies the five image data in parallel to the physical banks 51, 52, 53, 54 and 55 so that they are stored in the memory elements designated by the address decoders 71, 72, 73 and 74. Once the pixel data have been stored in the physical banks 51, 52, 53, 54 and 55 in this way, the image data read control circuit 3 reads the pixel data therefrom, and outputs voltage information based on the pixel data. The liquid crystal device 4 applies the voltages in response to the voltage information to the liquid crystal elements to have them display an image formed as a distribution of their transmittivity (reflectivity).

Next, the storing operation of the present embodiment 1 will be described.

FIG. 3 is a diagram illustrating the pixel matrix in the liquid crystal device 4, in which a plurality of pixels are arranged in s rows by r columns. In the present embodiment 1, it is assumed that the pixel data are input to the image data memory control circuit 1 in such a manner that the pixel data of the first row are successively input from (1,1) in the first column to (1,r) in the r-th column, followed by the input of the pixel data (2,1)–(2,r) in the second row, the pixel data (3,1)–(3,r) in the third row, . . . , and finally the pixel data (s,1)–(s,r) in the s-th row.

In such an input condition, the image data memory control circuit 1 successively supplies the image data memory circuit 2 with the pixel data of each row in groups of every five pixel data.

In the course of this, the image data memory control circuit 1 changes the destination of the output pixel data for each row. More specifically, as clearly seen by comparing FIG. 2 with FIG. 3, the destination of the pixel data are switched such that the first physical bank 51 stores the pixel data (1,1) of the first column of the first row in the pixel group, the pixel data (2,2) of the second column of the second row in the pixel group, the pixel data (3,3) of the third column of the third row in the pixel group, the pixel data (4,4) of the fourth column of the fourth row in the pixel group, and again the pixel data (1,1) of the first column of the fifth row in the pixel group.

Thus, the pixel data on a display screen is divided into pixel groups each consisting of 4 rows by 5 columns to be stored as shown in FIGS. 2 and 3, and each physical bank stores the pixel data of a different column and a different row in the pixel group when storing the pixel data.

Next, the read operation of the present embodiment 1 will be described.

First, in an operation mode in which the pixel data are read row by row, the five pixel data corresponding to the pixels (1,1)–(1,5) of the first row are read from the physical banks 51, 52, 53, 54 and 55 by actuating the first address decoder 71. This operation is repeated until the pixel data of the first row are completed. Subsequently, the five pixel data corresponding to the pixels (2,1)–(2,5) of the second row are read from the physical banks 51, 52, 53, 54 and 55 by actuating the second address decoder 72, and this operation is repeated until the pixel data of the second row are completed. Repeating such operations with the entire rows enables the image data necessary for generating a picture to be supplied to the liquid crystal device 4.

Second, in an operation mode in which the pixel data are read column by column, all the address decoders 71, 72, 73 and 74 are actuated so that four pixel data of the same column such as (1,1)–(4,1) are read from the physical banks 51, 52, 53, 54 and 55, followed by the repetition of the read operation until all the pixel data in the column are read. The read operation is carried out for the required number of columns. This enables a part of the display image to be rewritten to form a new picture.

As described above, the present embodiment 1 comprises n (=5) physical banks each including p (=4) memory groups, n memory buses each provided for one of the physical banks, and the selector for selecting a predetermined number (=5 or 4) of memory buses from among the n memory buses to output the image data therefrom. This makes it possible to reduce the number of buses to the number of the physical banks. Therefore, the number of the lines of the memory buses reduces by a factor of p as compared with that of the conventional image data storing integrated circuit, and the scale of the selector also reduces by the factor of p, accordingly. As a result, the present embodiment 1 can achieve a large scale, high gradation display with reducing the size of the image data storing integrated circuit and image data storing device.

Figure 6:
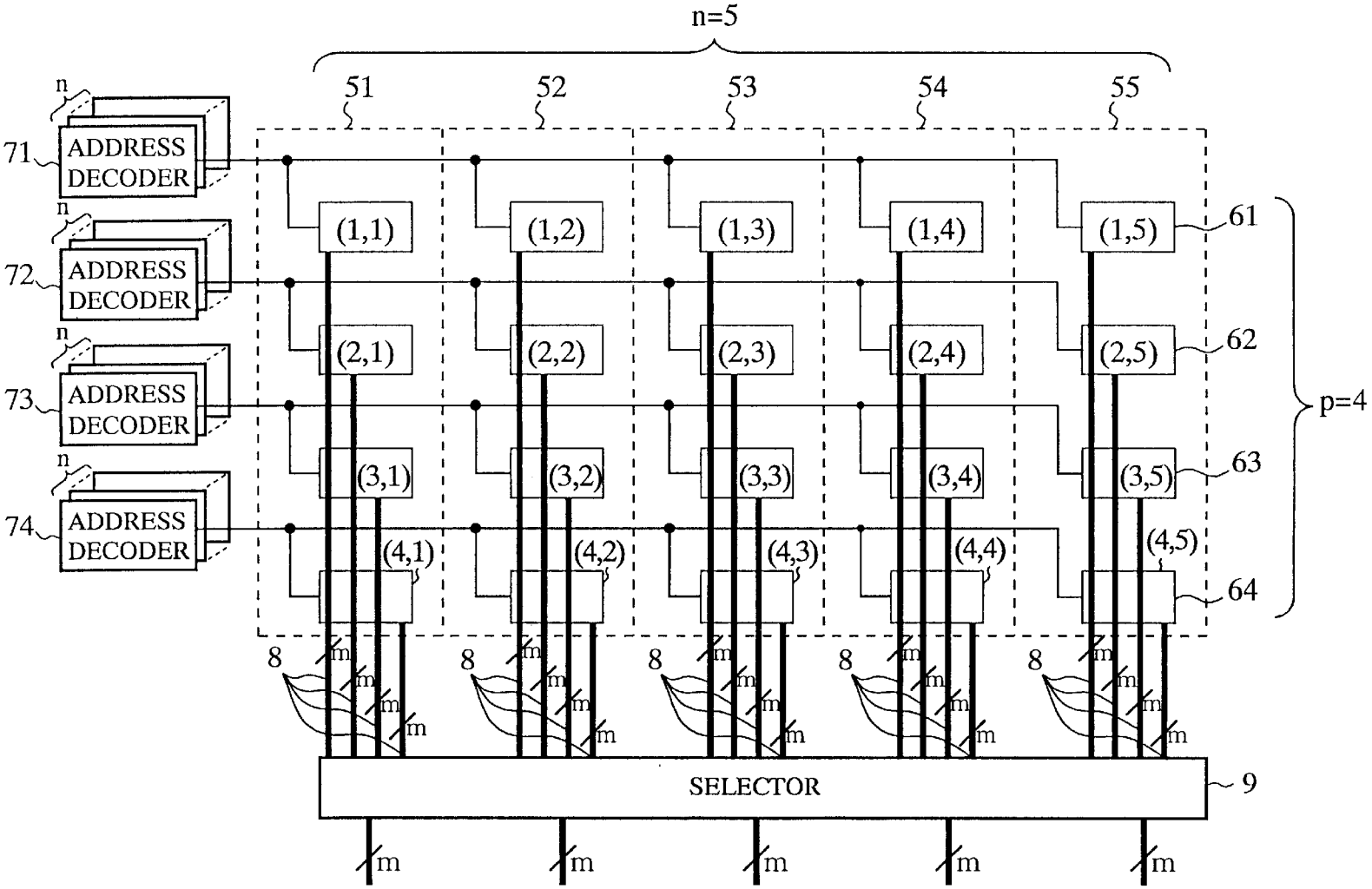
FIG.6 (PRIOR ART)
FIG. 6 is a block diagram showing a layout of a conventional image data storing integrated circuit.

Furthermore, since all the physical banks are provided in common with address decoders for selecting the memory elements that output the pixel data to the memory buses, it is not necessary to prepare the address decoders for respective memory groups as in the conventional image data storing integrated circuit as shown in FIG. 6. This enables the number of address decoders to be reduced by a factor n, thereby making it possible to achieve the large scale, high gradation display with reducing the size of the memory.

According to the present embodiment 1, a display image is divided into a plurality of pixel groups, each of which consists of n×p pixels, and each of the physical banks stores the pixel data of a different column and a different row in each pixel group. This makes it possible to simultaneously read not only a plurality of consecutive pixels in the row, but also a plurality of consecutive pixels in the column. Thus, even the device with its size reduced can rewrite, in groups of every p pixels, only columns associated with a location in which an image changes.

Embodiment 2

Figure 4:
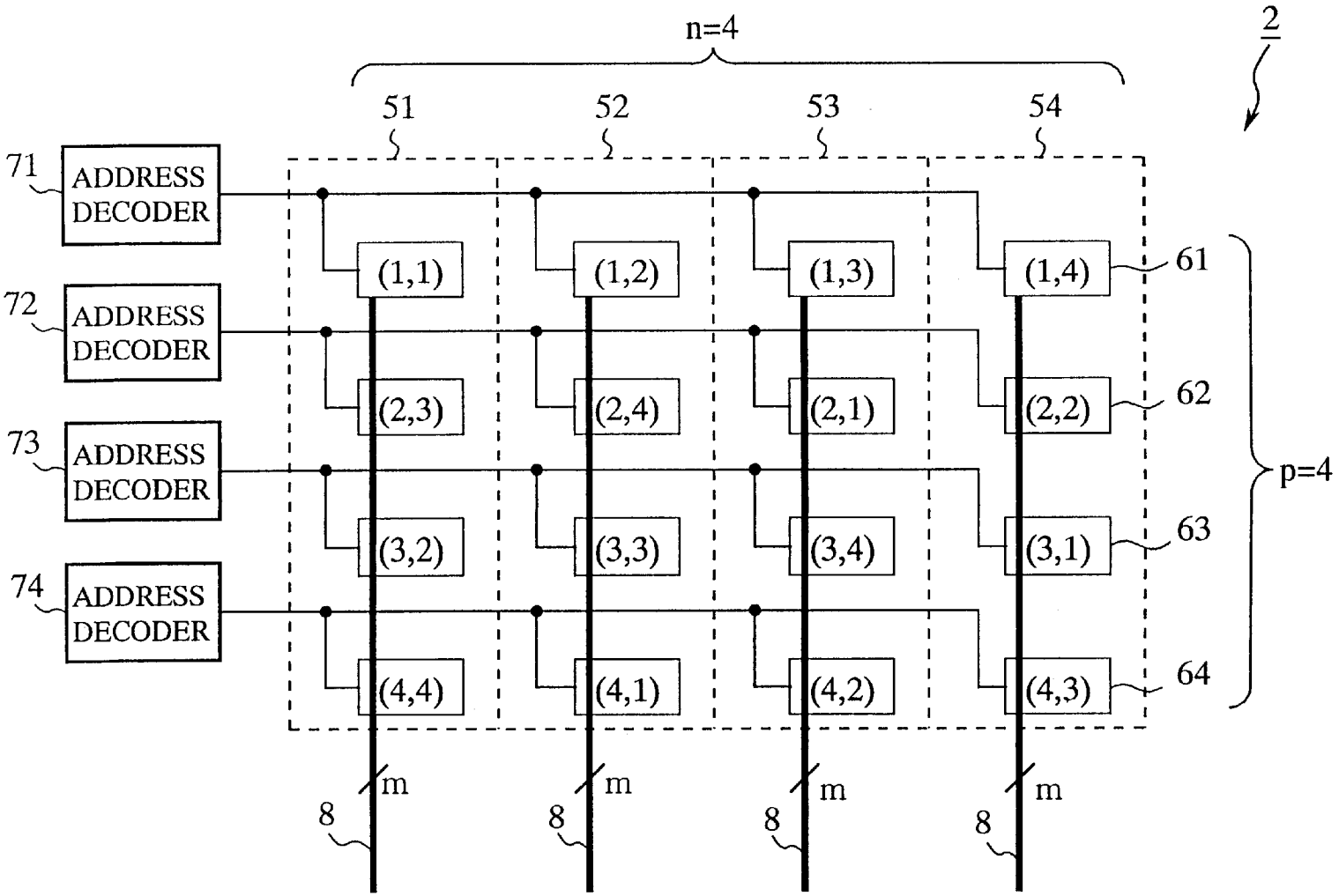
FIG. 4 is a block diagram showing a layout of an image data memory circuit of an embodiment 2 in accordance with the present invention.

FIG. 4 is a block diagram showing a layout of the image data memory circuit in an embodiment 2 of the image data storing device in accordance with the present invention. The embodiment 2 differs from the embodiment 1 in that it comprises four physical banks 51, 52, 53 and 54, and that the selector 4 is removed. Since the remaining portion is the same as that of the embodiment 1, the description thereof is omitted here by designating the corresponding portions by the same reference numerals.

Next, the operation of the embodiment 2 will be described.

In this embodiment, the pixel groups, each of which consists of four rows by four columns, are formed, and the pixel data stored in the memory groups 61, 62, 63 and 64 vary as shown in FIG. 4. The image data memory control circuit 1 outputs a group of four pixel data at the same time, and they are input directly to the physical banks 51, 52, 53 and 54 to be stored. The pixel data output from the physical banks 51, 52, 53 and 54 are directly supplied to the image data read control circuit 3. Since the remaining operation is the same as that of the embodiment 1, the description thereof is omitted here.

Thus, the embodiment 2 can reduce, besides the effect and advantages of the embodiment 1, the number of the buses to that of the physical banks, that is, can reduce the total number of bus lines by a factor of p as compared with the conventional image data memory. This is because the display image is divided into a plurality of pixel groups, each of which consists of n rows by n columns, where n=4 in FIG. 4, the physical banks each have a storage capacity capable of storing at least n pixel data in the pixel group, and the memory buses, each of which has a bus width needed for conveying the pixel data, are provided in one to one correspondence with the physical banks. Furthermore, the selector can be obviated because the number of lines of the memory buses equals the number of lines required for simultaneous reading of the pixel data. As a result, the large size, high gray-scale can be achieved with reducing the image data storage.

What is claimed is:

1. An image data storing device comprising:

a plurality of physical banks, each of which forms a repetition unit of a memory area, and has a storage capacity that can store a plurality of pixels in each of a plurality of pixel groups formed by dividing a display image;

a plurality of memory buses provided in one to one correspondence with said plurality of physical banks, each of said memory buses having a bus width needed for conveying pixel data associated with at least one of said pixels; and an image data control circuit for controlling storing of the pixel data such that each of said plurality of physical banks stores pixel data of a different column and a different row of said pixel groups, wherein the pixel data stored in said plurality of physical banks are simultaneously output through said memory buses to be displayed.

2. The image data storing device as claimed in claim 1, wherein each of said pixel groups consists of p×n pixels of said display image, and each of said plurality of physical banks can store at least p pixels, wherein p and n are natural numbers.

3. The image data storing device as claimed in claim 2, wherein said natural number p equals said natural number n.

4. The image data storing device as claimed in claim 2, further comprising a selector for selecting memory buses from among said plurality of memory buses, wherein said selector simultaneously outputs one of a set of p pixel data and a set of n pixel data supplied from said plurality of physical banks through said memory buses.

5. The image data storing device as claimed in claim 3, further comprising p address decoders for selecting memory elements of said plurality of physical banks in parallel, said memory elements each storing at least one of said pixel data.

6. The image data storing device as claimed in claim 4, further comprising p address decoders for selecting memory elements of said plurality of physical banks in parallel, said memory elements each storing at least one of said pixel data.

7. The image data storing device as claimed in claim 1, wherein said image data storing device is formed in an integrated circuit.

8. An image data storing method comprising the steps of:

dividing an image data to be displayed into a plurality of pixels groups, each of which consists of p×n pixel data, where p and n are natural numbers; and storing into each of a plurality of physical banks a set of p pixel data of each of said pixel groups such that each of said plurality of physical banks stores pixel data of a different column and a different row of said pixel groups.

* * * * *